US005787527A

United States Patent [19]

Anderson

[11] Patent Number: 5,787,527

[45] Date of Patent: Aug. 4, 1998

[54] IMPERVIOUS CHILDRENS MAT COVER

[76] Inventor: Robin L. Anderson, 1347 Gasparilla Dr., Fort Myers, Fla. 33901

[21] Appl. No.: 856,323

[22] Filed: May 14, 1997

Related U.S. Application Data

[60] Provisional application No. 60/017,617 May 14, 1996.

[51] Int. Cl. [6] ..... A47G 9/00

[52] U.S. Cl. ..... 5/484; 5/490; 5/500

[58] Field of Search ..... 5/737, 738, 490, 5/484, 482, 486, 499, 500, 501, 502

[56] References Cited

U.S. PATENT DOCUMENTS

| | | | |
|---|---|---|---|
| 834,643 | 10/1906 | Schnadig | 5/484 |
| 880,524 | 3/1908 | Hauphoff | 5/490 |
| 1,339,738 | 5/1920 | Callahan et al. | 5/484 |
| 2,759,200 | 8/1956 | Johnston | 5/490 |
| 3,044,517 | 7/1962 | Levi | 5/490 |
| 5,321,861 | 6/1994 | Dancey et al. | 5/490 |
| 5,507,049 | 4/1996 | Lane | 5/484 |

FOREIGN PATENT DOCUMENTS

| | | | |
|---|---|---|---|
| 481762 | 3/1952 | Canada | 5/484 |

*Primary Examiner*—Alexander Grosz
*Attorney, Agent, or Firm*—William E. Noonan

[57] ABSTRACT

A cover for a child's rest mat includes an upper cover section and a lower cover section that conforms to the upper cover section and is interconnected thereto along respective peripheral edges of the upper and lower cover sections to form an interior space. An opening is formed into the interior space through one of the upper and lower cover sections exclusively. A child's rest mat is inserted into the interior space though the opening and the upper and lower cover section have a size and shape such that the cover snugly engages the mat.

1 Claim, 2 Drawing Sheets

IMPERVIOUS CHILDRENS MAT COVER

RELATED PROVISIONAL APPLICATION

This application is a continuation of provisional application Ser. No. 60/017,617 filed May 14, 1996.

FIELD OF THE INVENTION

This invention relates to a mat cover and, more particularly, to a washable cover for use with children's rest mats and pads.

BACKGROUND OF THE INVENTION

A wide variety of rest mats and pads are presently available for use by small children. These products are often employed at nursery schools, kindergartens, day care centers and other locations where young children are required to take mid-day naps. Traditionally, plastic, foam-filled pads have been used. Because these products are often used repeatedly by many different children, they tend to collect dirt, stains and germs. Moreover, the plastic mat surface can cause a child to perspire. Conventional mats therefore tend to be unsanitary and uncomfortable and make it difficult for the child to nap or rest comfortably. Washing or otherwise cleaning these mats is time consuming and annoying.

In an effort to overcome these problems, a number of removable mat covers have been developed. See, for example, Scott, U.S. Pat. No. 5,099,530, Alonzo, U.S. Pat. No. 5,203,041 and Wolter, U.S. Pat. No. 5,394,575. Unfortunately, in each of these known products, the pad cannot be easily removed from the rest mat for washing. Additionally, no known mat covers exhibit both a soft comfortable feel and waterproof resistance to water, drinks, urine and other liquids. A cover used for a child's rest mat should be soft so that the child can nap comfortably on the mat and, at the same time, waterproof so that it protects the underlying mat from dirt, germs and stains. Such protection would greatly reduce the need to wash the mat itself and would prolong the life of the mat.

A further disadvantage of conventional mat covers is that they exhibit a fairly complicated construction. This contributes to the difficulty and expense of constructing the product.

SUMMARY OF INVENTION

It is therefore an object of the present invention to provide an improved cover for floor mats and particularly for children's rest mats.

It is a further object of this invention to provide a mat cover that is both comfortable for the child and resistant to liquids.

It is a further object of this invention to provide a mat cover that protects the underlying mat from being soiled or stained so that the need to clean the mats is minimized and the life of the mat is prolonged.

It is a further object of this invention to provide a mat cover that employs a sturdy, long-lasting construction.

It is a further object of this invention to provide a mat cover that is constructed so that a standard mat may be quickly and conveniently fitted into the cover and removed from the cover, as required.

It is a further object of this invention to provide a children's mat cover that is quick and convenient to wash so that the children's mat may be maintained in a clean and sanitary condition.

This invention features a mat cover that is particularly suited for use on a child's rest mat. The cover includes an upper section and a lower section that are interconnected along the perimeter of the cover, such as by stitching or similar means. An opening is formed, preferably in the lower section, for receiving a mat. The upper and lower sections have dimensions such that the mat is snugly fitted within the cover.

In a preferred embodiment, the upper section includes an outer fabric layer and an inner waterproof layer. For example, the outer layer may be cloth or a similar, relatively soft fabric. Natural fibers are preferred so that the cover provides an acceptable degree of comfort and does not make the person lying on the mat perspire excessively, as may be the case with a synthetic fabric. The inner layer comprises any known type of fairly thin, waterproof material. The inner and outer layers are juxtaposed and stitched or sewn together in a known fashion to form the upper section.

The lower section preferably comprises a fabric similar to the outer layer fabric in the upper section. Normally both the upper and lower sections have generally rectangular sheet-like configurations. The lower section is secured to the upper section by stitching or similar means formed along the perimeter of the upper and lower sections. A transverse opening is formed proximately midway along the length of the lower section. Preferably, the lower section includes a transverse slit that divides the lower section into adjoining segments. The edges of the adjoining segments typically overlap proximate the opening in a manner resembling a sham cover used on pillows. These adjoining edges may be separated to widen the opening so that a mat is introduced into the cover through an opening in the bottom section.

DETAILED DESCRIPTION OF PREFERRED EMBODIMENTS

Other objects, features and advantages will occur from the following description of preferred embodiments and the accompanying drawings, in which.

There is shown in FIGS. 1–4 a cover 10 for a child's rest mat 12. Cover 10 features a flexible construction and has a generally rectangular shape, which closely conforms to the shape of the enclosed mat 12.

Figure 1:
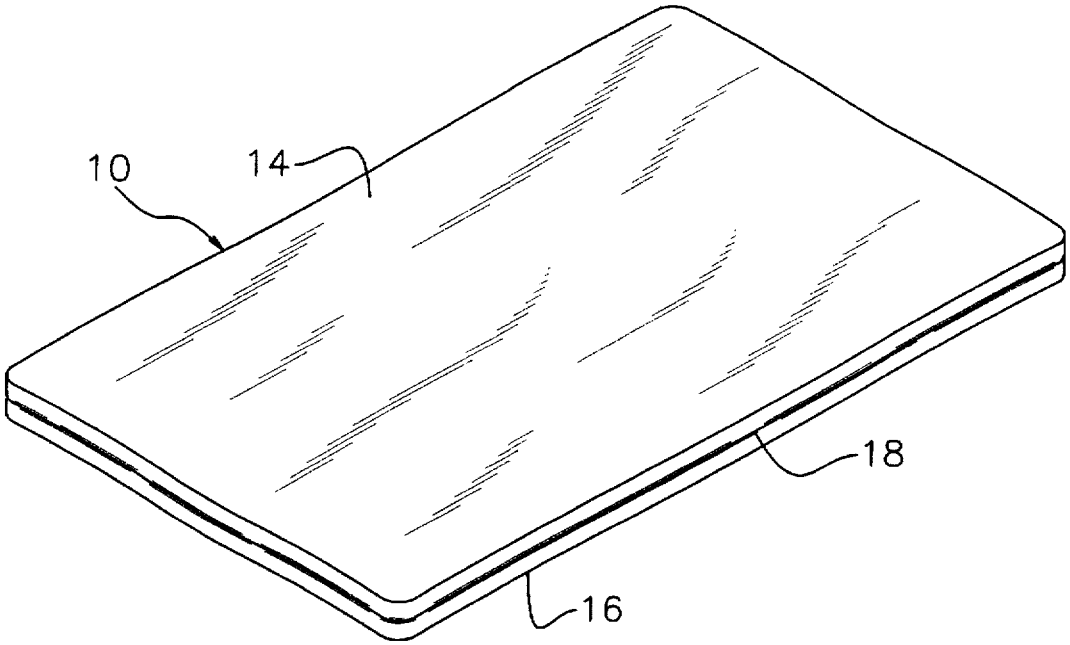
FIG. 1 is a perspective view of a mat cover according to this invention.
Figure 2:
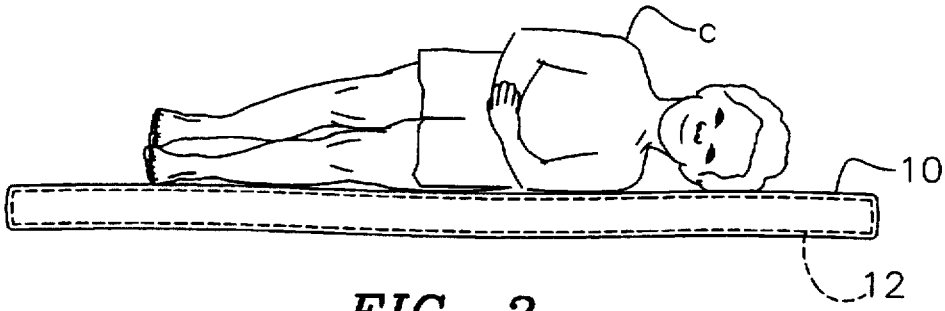
FIG. 2 is an elevational side view of the mat cover surrounding the child's mat with a child resting thereon.

As best illustrated in FIG. 1, cover 10 includes an upper section 14 and a lower section 16. The upper and lower sections are sewn, stitched or otherwise interconnected along peripheral edge 18. In use, the cover fully encloses a generally planar mat or pad. Mat 12 is a standard child's rest mat, such as those widely used in kindergartens, nursery schools and pre-schools. Most mats feature an inner foam member enclosed by a vinyl or other plastic shell. Cover 10, in turn, encloses mat 12 so that child C can rest comfortably on the covered mat in the manner illustrated in FIG. 2.

Figure 3:
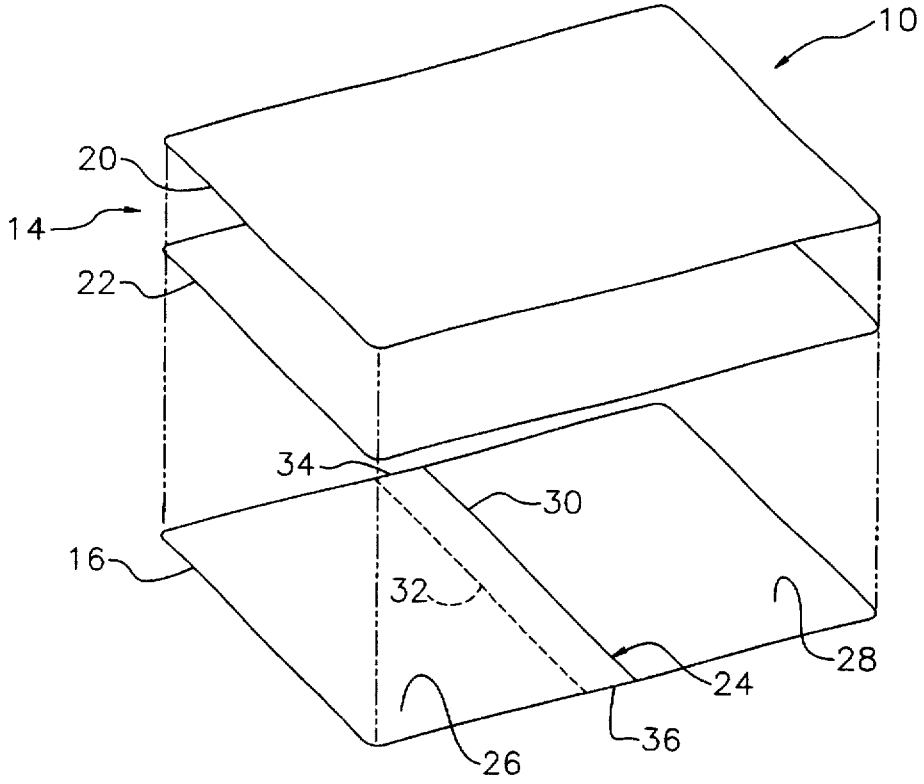
FIG. 3 is an exploded view of the mat cover illustrating the individual sheet-like layers of the cover.

As shown in FIG. 3, upper cover section 14 comprises a pair of sheet-like layers 20 and 22 that are sewn or otherwise interconnected along the peripheral edges of those layers. Outer layer 20 preferably includes a soft, washable fabric material that is comfortable for the child to lie upon and which contacts the child without causing the child to unduly perspire. Inner layer 22 features a waterproof material such as vinyl or some other type of synthetic substance. Layers 20 and 22 are sewn together in the manufacturing process so that they define a one-piece upper section 14.

Lower section 16 preferably comprises a soft fabric similar to that forming upper layer 20. The lower section typically includes a single sheet-like layer, although, in alternative embodiments, two layers analogous to those comprising upper section 14 may be utilized for the lower section of the cover. The lower section also features a transverse, slit-like opening 24 formed across section 16. More particularly, lower section 16 includes a first rectangular half piece 26 and a second rectangular half piece 28. Piece 26 includes an inner right-hand edge 30 and second piece 28 includes an outer left-hand edge 32 Edges 30 and 32 overlap in the manner shown in FIG. 3. Pieces 26 and 28 are interconnected along longitudinal edges 34 and 36 but edges 30 and 32 are not sewn or otherwise directly attached to pieces 28 and 26, respectively. As a result, the overlapping edges 30 and 32 define transverse opening 24 of lower section 16. In alternative embodiments, opening 24 may be secured closed by various types of closures including but not limited to Velcro and snap fasteners.

Figure 4:
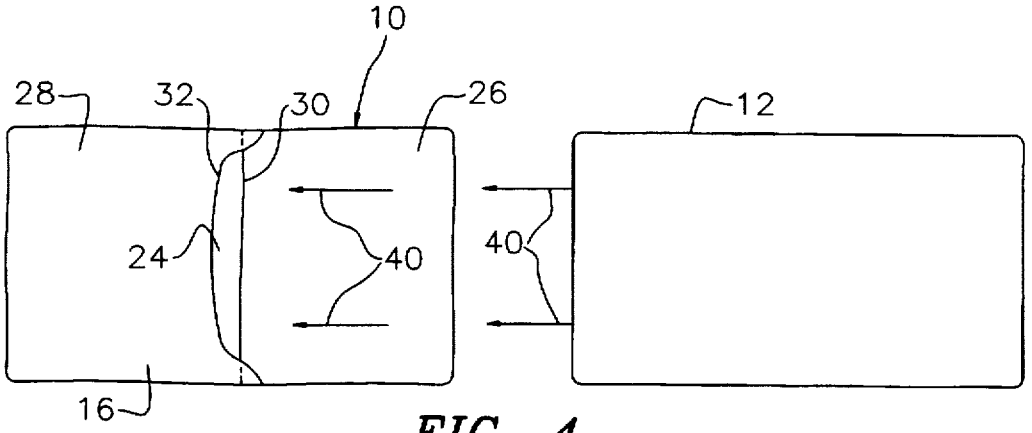
FIG. 4 is a bottom plan view of the mat cover with the opening exposed to receive a standard child's rest mat.

Mat 12 is fitted into cover 10 in the manner shown in FIG. 4. Transverse edges 32 and 30 of bottom section 16 are separated to expose opening 24 of cover 10. Mat 12 is then inserted through the opening as indicated by arrows 40. First, the left-hand side of the mat is received by the cover. Then the mat is folded and manipulated to insert the right-hand end of the mat into the cover. As a result, the cover is fitted onto the mat in the manner shown in FIGS. 1 and 2. It can then be conveniently used by the child during rest periods and at other times. Subsequently, the mat can be quickly and conveniently removed by reversing this process. The mat is folded and otherwise manipulated to remove first one end and then the other end from cover 10.

In alternative embodiments, waterproof layers may be employed in both the upper and lower sections of the cover. In still other versions, the upper section may comprise a quilted fabric that carries a backing made of vinyl or some other type of plastic. This similarly provides the upper section of the cover with a soft fabric outer surface and a waterproof inner surface.

In each of the embodiments described herein, it is quite important that the outer surface of the upper section include a soft fabric material such as cotton or a similar substance. This permits the child to lie and nap comfortably on the mat without perspiring. At the same time, the employment of an inner waterproof layer is also quite important. This keeps the mat relatively clean and free of perspiration, stains, dirt and germs. The cover permits significantly improved sanitary use of rest mats in schools and similar locations. The child does not directly contact the mat. Instead, each child may bring his or her own cover to school. The cover can then be fitted onto the mat and used by the child at school. Subsequently, it can be removed and washed between each use. This eliminates constant cleaning and maintenance of the mat itself. The life of the mat is prolonged significantly and the school is thereby able to reduce costs associated with replacing and/or cleaning the mat.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A cover for a child's rest mat, said cover comprising:

a rectangular, sheet-like upper cover section having an outer layer composed of a soft fabric material and a separate and distinct inner layer composed of a waterproof material, said outer and inner layers being permanently attached to each other around their peripheries;

a rectangular lower cover section comprising a single sheet-like layer that conforms to said upper cover section and is composed of a soft fabric material, said lower cover section being juxtaposed against and interconnected to said upper cover section along respective peripheral edges of said upper and lower cover sections to form an interior space; and means defining an opening into said interior space through said lower cover section exclusively, said opening being formed transversely across and midway along the length of said lower cover section and including a transverse slit that divides said lower section into adjoining segments, said adjoining segments including transverse edge portions that overlap one another to define said opening, said adjoining edge portions being separable to widen said opening and permit introduction of a child's rest mat into said interior space through said opening; said upper and lower cover sections having a size and shape such that the cover snugly engages the mat introduced into said interior space.

* * * * *